US010641466B2

(12) United States Patent
Chen et al.

(10) Patent No.: US 10,641,466 B2
(45) Date of Patent: May 5, 2020

(54) LIGHT EMITTING DIODE MODULE AND MANUFACTURING METHOD THEREFOR, AND LAMP

(71) Applicant: Hangzhou HPWinner Opto Corporation, Hangzhou (CN)

(72) Inventors: Kai Chen, Hangzhou (CN); Jianming Huang, Hangzhou (CN)

(73) Assignee: HANGZHOU HPWINNER OPTO CORPORATION, Hangzhou (CN)

( * ) Notice: Subject to any disclaimer, the term of this patent is extended or adjusted under 35 U.S.C. 154(b) by 0 days.

(21) Appl. No.: 16/082,819

(22) PCT Filed: Mar. 10, 2017

(86) PCT No.: PCT/CN2017/076320
§ 371 (c)(1),
(2) Date: Sep. 6, 2018

(87) PCT Pub. No.: WO2017/152879
PCT Pub. Date: Sep. 14, 2017

(65) Prior Publication Data

US 2019/0032898 A1 Jan. 31, 2019

(30) Foreign Application Priority Data

Mar. 11, 2016 (CN) ..... 2016 1 0140714

(51) Int. Cl.
*F21V 19/00* (2006.01)
*F21V 27/00* (2006.01)
(Continued)

(52) U.S. Cl.
CPC ..... *F21V 19/003* (2013.01); *F21S 2/005* (2013.01); *F21V 5/007* (2013.01); *F21V 5/04* (2013.01);
(Continued)

(58) Field of Classification Search
CPC ..... F21V 19/003; F21V 31/005; F21V 27/00; F21V 29/70; F21V 5/04; F21V 31/00
See application file for complete search history.

(56) References Cited

U.S. PATENT DOCUMENTS

2012/0106174 A1 5/2012 Chuang et al.
2016/0069557 A1 3/2016 Ruckgauer

FOREIGN PATENT DOCUMENTS

CN 201973590 U 9/2011
CN 102364685 A 2/2012
(Continued)

OTHER PUBLICATIONS

Extended European Search Report dated Oct. 17, 2019 in European Patent Application No. 17762565.4.

*Primary Examiner* — Joseph L Williams
(74) *Attorney, Agent, or Firm* — Plumsea Law Group, LLC.

(57) ABSTRACT

A light emitting diode module and a lamp. The light emitting diode module includes: at least one light emitting diode element; a bottom plate for supporting the light emitting diode element; a lens assembly disposed on the light emitting surface side of the light emitting diode element; and an annular sealing member disposed between the lens assembly and the bottom plate, wherein the light emitting diode element is located in a sealed space formed by the lens assembly, the bottom plate, and the annular sealing member.

15 Claims, 6 Drawing Sheets

(51) Int. Cl.

| | |
|---|---|
| ***F21V 29/70*** | (2015.01) |
| ***F21V 31/00*** | (2006.01) |
| ***F21V 5/04*** | (2006.01) |
| ***F21S 2/00*** | (2016.01) |
| ***F21V 5/00*** | (2018.01) |
| ***F21V 15/01*** | (2006.01) |
| *F21S 8/08* | (2006.01) |
| *F21W 131/103* | (2006.01) |
| *F21V 23/00* | (2015.01) |
| *F21Y 105/16* | (2016.01) |
| *F21Y 115/10* | (2016.01) |

(52) U.S. Cl.

CPC ..... *F21V 15/01* (2013.01); *F21V 27/00* (2013.01); *F21V 29/70* (2015.01); *F21V 31/005* (2013.01); *F21S 8/086* (2013.01); *F21V 5/048* (2013.01); *F21V 23/002* (2013.01); *F21W 2131/103* (2013.01); *F21Y 2105/16* (2016.08); *F21Y 2115/10* (2016.08)

(56) References Cited

FOREIGN PATENT DOCUMENTS

| | | | |
|---|---|---|---|
| CN | 202733519 | U | 2/2013 |
| CN | 203082721 | U | 7/2013 |
| CN | 203703908 | U | 7/2014 |
| CN | 104121494 | A | 10/2014 |
| JP | 2007213881 | A | 8/2007 |
| JP | 3171377 | U | 10/2011 |
| JP | 20152032 | A | 1/2015 |
| JP | 2015173125 | A | 10/2015 |
| KR | 20120101907 | A | 9/2012 |
| WO | 2011023927 | A1 | 3/2011 |

LIGHT EMITTING DIODE MODULE AND MANUFACTURING METHOD THEREFOR, AND LAMP

TECHNICAL FIELD

Embodiments of the present invention provide a light-emitting diode module, a manufacturing method thereof, and a lamp.

BACKGROUND

Light emitting diode (LED) lighting device possesses excellent application prospect for its advantages such as energy saving, long service life, good applicability, short response time, and environmental protection.

Because the LED has a performance susceptible to humidity, temperature and mechanical vibration, in order to allow for a normal operation during the service life, the LED is required to possess good waterproofness, heat dissipation and resistance to mechanic vibration.

SUMMARY

An embodiment according to the present invention provides a light-emitting diode (LED) module, including: at least one LED element; a base plate configured to support the LED element; a lens component disposed at a light emergent side of the LED element; and an annular sealing part disposed between the lens component and the base plate, wherein the LED element is located within an sealed space formed by the lens component, the base plate and the annular sealing part.

Another embodiment of the present invention provides a manufacturing method of a light-emitting diode (LED) module, including: connecting a LED element to a print circuit board (PCB); electrically connecting a conducting wire to the PCB; assembling a lens component with the PCB, and disposing an annular sealing part between the lens component and the PCB, so as to form an sealed space in a region enclosed by the annular sealing part and between the lens component and a base plate; the LED element is located within the sealed space.

Another embodiment of the present invention provides a lamp, including a lamp housing and the above-mentioned LED module; the lamp housing includes a chamber in which the LED module is fixed.

BRIEF DESCRIPTION OF THE DRAWINGS

Hereinafter, the drawings accompanying embodiments of the present disclosure are simply introduced in order to more clearly explain technical solution(s) of the embodiments of the present disclosure. Obviously, the described drawings below are merely related to some of the embodiments of the present invention without constituting any limitation thereto.

DETAILED DESCRIPTION

In order to make objects, technical details and advantages of the embodiments of the invention apparent, technical solutions according to the embodiments of the present invention will be described clearly and completely as below in conjunction with the accompanying drawings of embodiments of the present invention. It is to be understood that the described embodiments are only a part of but not all of exemplary embodiments of the present invention. Based on the described embodiments of the present invention, various other embodiments can be obtained by those of ordinary skill in the art without creative labor and those embodiments shall fall into the protection scope of the present invention.

Unless otherwise defined, all the technical and scientific terms used herein have the same meanings as commonly understood by one of ordinary skill in the art to which the present invention belongs. The terms, such as "first," "second," or the like, which are used in the description and the claims of the present application, are not intended to indicate any sequence, amount or importance, but for distinguishing various components.

Some embodiments according to the present invention provide a light-emitting diode (LED) module, including at least one LED element; a base plate (a base of the LED element) for supporting the LED element; a lens component disposed at a light emergent side of the LED element; and an annular sealing part disposed between the lens component and the base plate. The LED element is located within a sealed space formed by the lens component, the base plate and the annular sealing part.

Figure 1:
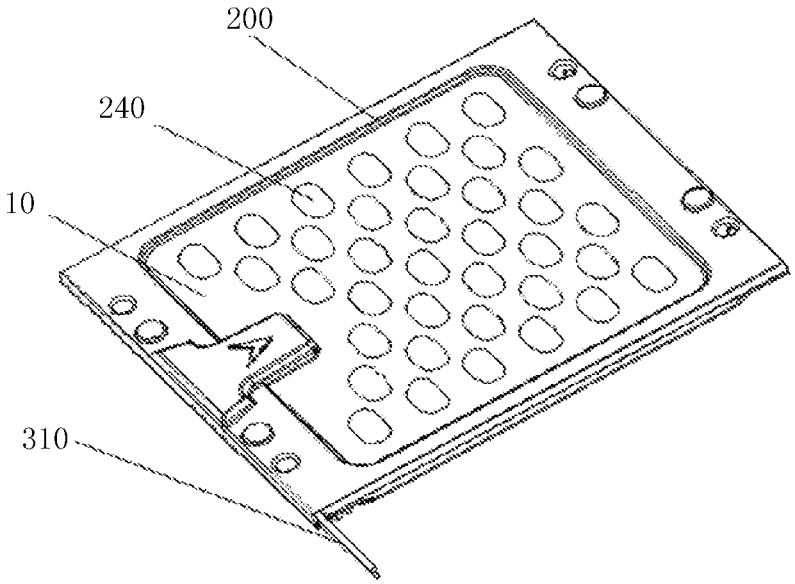
FIG. 1 is a top view illustrating a LED module according to an embodiment of the present invention.
Figure 2:
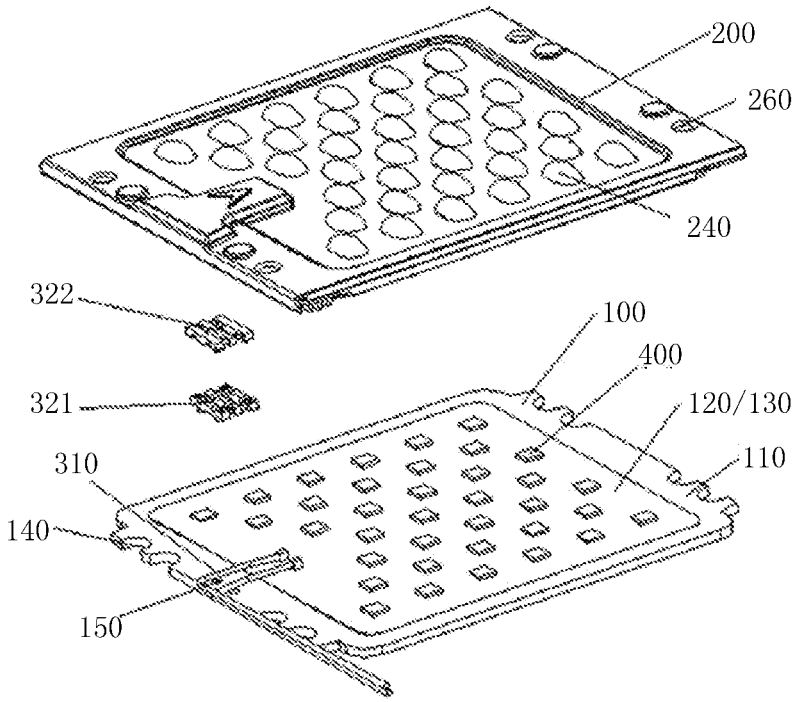
FIG. 2 is an exploded view illustrating a LED module according to an embodiment of the present invention.
Figure 3:
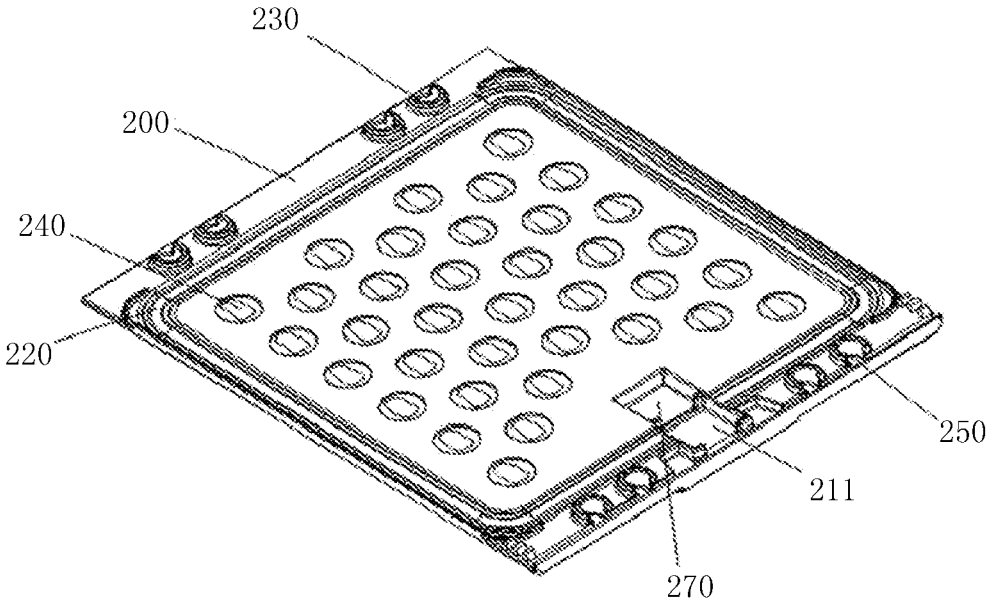
FIG. 3 is a schematic view illustrating a lens component (a side facing a base plate) of a LED module according to an embodiment of the present invention.
Figure 4:
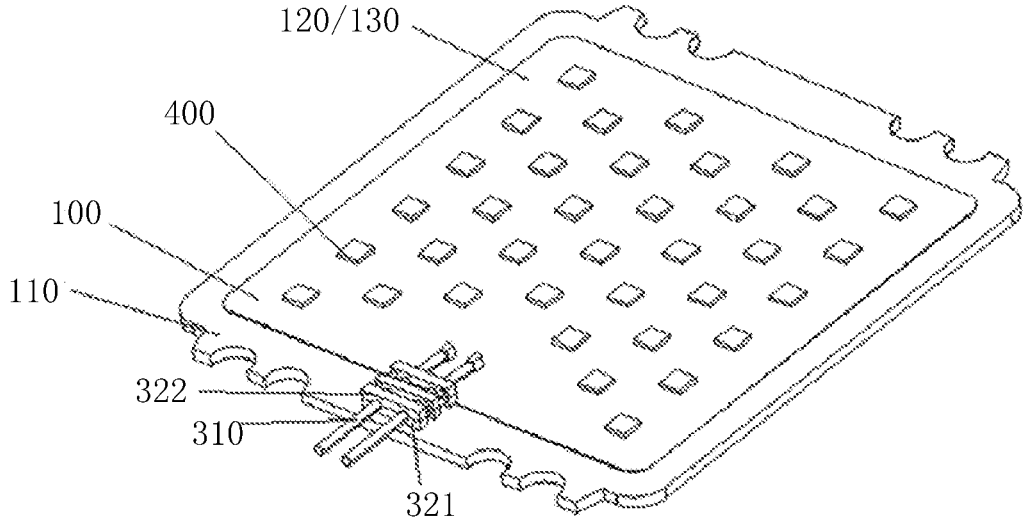
FIG. 4 is a schematic view illustrating a base plate of a LED module according to an embodiment of the present invention.
Figure 5:
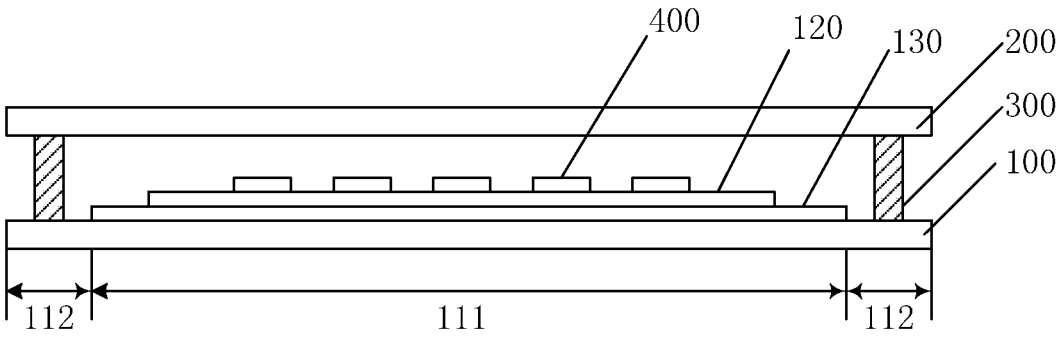
FIG. 5 is a sectional view illustrating a LED module according to an embodiment of the present invention.

FIG. 1 is a top view illustrating a LED module according to an embodiment of the present invention; FIG. 2 is an exploded view illustrating a LED module according to an embodiment of the present invention; FIG. 3 is a schematic view illustrating a lens component (a side facing a base plate) of a LED module according to an embodiment of the present invention; FIG. 4 is a schematic view illustrating a base plate of a LED module according to an embodiment of the present invention; and FIG. 5 is a sectional view illustrating a LED module according to an embodiment of the present invention. In FIG. 5, some parts are illustrated in a simplified and exaggerated way while some parts are omitted, so as to clearly explain relationships among components. Referring to FIG. 1, FIG. 2 and FIG. 5, a LED module 10 according to an embodiment of the present invention includes a base plate 100, a lens component 200 disposed opposite to the base plate 100, and an annular sealing part 300 located between the base plate 100 and the lens component 200. The annular sealing part can be a gel gasket formed by solidifying a gel, and can also be other appropriate elastic members. The annular sealing part 300 is engaged with the base plate 100 and the lens component 200 so as to form a sealed space surrounded by the annular sealing part 300 between the base plate 100 and the lens component 200. The LED module according to an embodiment of the present invention further includes at least one LED element 400 which is supported on the base plate 100 and is located within the above-mentioned sealed space.

For example, the lens component 200 and the base plate 100 are disposed opposite to each other, and the annular sealing part is disposed between the lens component 200 and the base plate 100, so as to form a sealed space between the lens component 200 and the base plate 100.

Figure 8:
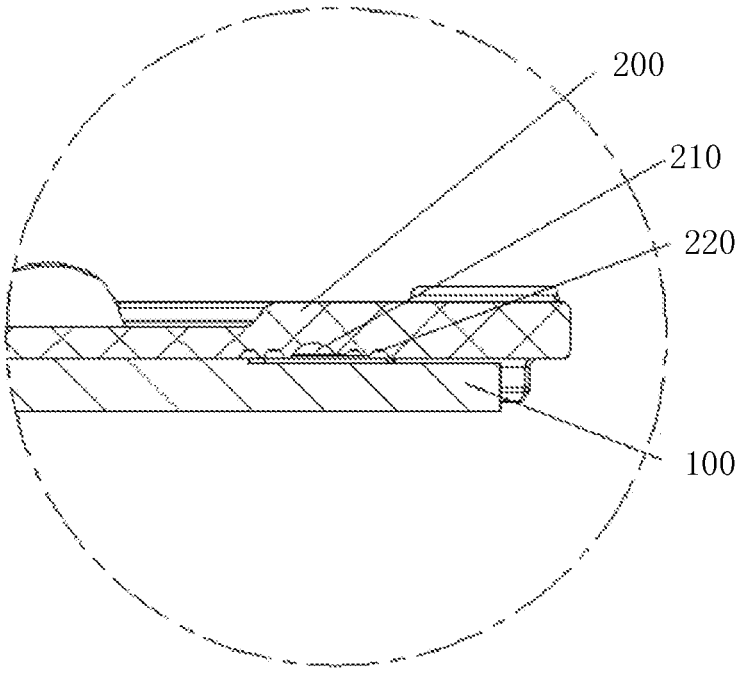
FIG. 8 is a partially sectional view illustrating a LED module according to an embodiment of the present invention.

The annular sealing part 300 is not illustrated in FIG. 1 and FIG. 2, and reference may be made to the sectional view of FIG. 5. Moreover, an example of the annular sealing part can also refer to FIG. 8 which will be described later. FIG. 8 illustrates a tank 210 for accommodating glue. The glue in the glue tank 210 can be formed into the annular sealing part 300 after being solidified. Of course, the embodiment of the present invention is not limited thereto. For example, during manufacturing the LED module, the gel gasket can be coated onto a lens in a state of gel, and then be gradually solidified during solidification; furthermore, the base plate and the lens component in the embodiment of the present invention are bonded together by means of the gel gasket, and a sealed space is formed and surrounded by the gel gasket between the base plate and the lens component. For example, the gel gasket herein can be an adhesion agent which has been solidified. As a result, the gel gasket can also be referred to as an adhesion agent, which is disposed at a periphery region of the LED module and used for connecting the lens component and the base plate. A material of the adhesion agent is not particularly limited in the embodiment of the present invention, and any appropriate adhesion agent capable of bonding the lens component with the base plate can be adopted. In an embodiment of the present invention, the annular sealing part can possess functions of both sealing and bonding the base plate and the lens component, and can also possess only the function of sealing without the function of bonding. In the latter case, the bonding between the base plate and the lens component can also be achieved by other ways (e.g., by using a screw).

For example, as illustrated in FIG. 2 or FIG. 4, a plurality of LED elements 400 can be disposed on the base plate 100 in an array. However, the embodiment of the present invention is not limited thereto, and the LED elements of the LED module according to an embodiment of the present invention can be disposed on the base plate 100 in any appropriate way, or the LED module can include only one LED element. For example, the LED element 400 as used in the LED module according to an embodiment of the present invention is not particularly limited. For example, the LED element 400 can include a LED chip, an independently encapsulated LED lamp bead, an integrated LED (also referred to as COB), a multi-core encapsulated chip, a CSP, and the like.

As illustrated in FIGS. 1-3, the lens component 200 can have at least one lens part 240, each lens part 240 can be corresponding to one LED element 400 and is used for performing a light distribution to the corresponding LED element 400. However, the LED module according to the embodiment of the present invention is not limited thereto, and each lens part 240 can be corresponding to several LED elements 400. For example, a specific form of the lens component 200 is not particularly limited. For example, the lens component 200 can be a plate-shaped component provided with a plurality of lenses, or the lens component 200 itself can be a lens. Or, the lens component 200 can be provided with a reinforcing rib, or the lens component 200 can be partially thickened to prevent from deforming. A material of the lens component 200 can be any material satisfying mechanical and optical properties, for example, PC (polycarbonate) or PMMA (polymethyl methacrylate, also referred to as acrylic).

For example, a plurality of LED elements, arranged in an array, is disposed on a print circuit board (PCB), and the lens component includes a plurality of lens parts each corresponding to one LED element; that is to say, the LED elements are disposed in one-to-one correspondence with the lens parts. Each of the lens parts performs a light distribution to a corresponding LED element. Each of the LED elements can include one or more LED chip.

In an embodiment according to the present invention, the base plate 100 of the LED module can be a PCB. The PCB as used according to the embodiment of the present invention can be any one or more selected from the group consisting of a metal-based PCB, a ceramic-based PCB and a plastic-based PCB. The metal-based PCB, the ceramic-based PCB and the plastic-based PCB respectively refer to that a substrate of the PCB is a metallic substrate, a ceramic substrate and a plastic substrate. However, the embodiment of the present invention is not limited thereto. The PCB includes a substrate and a printed circuit layer formed on the substrate. As illustrated in FIG. 2, FIG. 4 and FIG. 5, the base plate 100 includes a substrate 110 and a printed circuit layer 120 formed on the substrate 110. For example, the printed circuit layer 120 is formed at a side of the substrate 100 facing the lens component. As illustrated in FIG. 5, the substrate 110 includes a central region 111 and a periphery region 112 surrounding the central region 111. The printed circuit layer 120 is located in the central region of the substrate 110. Therefore, the periphery region 112 of the substrate 110 will be exposed to the outside for it's not covered by the printed circuit layer. Moreover, an insulating layer 130 can further be disposed between the substrate 110 and the printed circuit layer 120 of the PCB 100. For example, the insulating layer 130 is also located in the central region 111 of the substrate 100. Therefore, the periphery region 112 of the substrate 110 is not covered by the insulating layer, either. Additionally, the insulating layer 130 itself can also include a central region and a periphery region surrounding the central region, and the printed circuit layer 120 for example is located in the central region of the insulating layer 130. In the case of metal-based PCB, the insulating layer 130 can ensure an electrical isolation between the metallic substrate 110 and the printed circuit layer 120. Moreover, the printed circuit layer 120 is disposed in the central region of the insulating layer 130, and an edge of the printed circuit layer is spaced from an edge of the insulating layer 130 by a certain distance, so as to ensure an appropriate creepage distance.

The substrate 110 can be a plate-shaped component, for example, a flat plate-shaped component. For the metallic substrate, a material thereof is not particularly limited, for example, the material can be aluminum, aluminum alloy and the like having good thermal conductivity. For the ceramic substrate, a material thereof is not particularly limited, for example, the material can be aluminum nitride, silicon carbide and the like. For the plastic substrate, a material thereof is not particularly limited, either; for example, the material can be a phenolic aldehyde cotton paper, epoxy resin, an inorganic/organic composite material, and the like. The printed circuit layer 120 can include a single layer of circuit or multiple layers of circuits, or can be a composite structure of a circuit and an insulating material.

In a LED module according to an embodiment of the present invention, the LED element 400 disposed on the base plate 100 can be electrically connected to the printed circuit layer 120; that is, electrically connected to a circuit in the printed circuit layer 120. In this way, a power supply or other driving signal(s) can be provided for the LED element 400 by means of the circuit in the printed circuit layer 120, so as to control the LED element 400 to emit light.

In the embodiment of the present invention, the insulating layer 130 and the printed circuit layer 120 are distributed in the central region of the substrate but not in the periphery region (edge portion). The annular sealing part (e.g., liquid gel gasket, adhesion agent, and the like) is coated on the substrate of the PCB, and surrounds the insulating layer and the printed circuit layer. That is to say, the adhesion agent is coated onto an exposed region (the periphery region) of the substrate which is not covered by the insulating layer.

For example, the annular sealing part 300 is disposed in the periphery region 122 of the substrate 120. That is to say, the annular sealing part 300 is formed at the outer side of the printed circuit layer 120. In the periphery region 122, the substrate 120 is not covered by the printed circuit layer or other layer(s), thus the annular sealing part 300 can be in direct contact with the substrate 110. Moreover, the other side of the annular sealing part 300 can be in direct contact with the lens component 200 so as to form the sealed space in a better way.

In the embodiment of the present invention, the lens component and the substrate of the PCB are directly connected (or bonded) together by the annular sealing part (e.g., glue, adhesion agent or elastic component, etc.), which is advantageous in that it can prevent moisture or the like from entering the sealed space between the lens component and the PCB through a gap between the substrate and the printed circuit layer or the insulating layer, as compared with the case of directly connecting (or bonding) the lens component with the printed circuit layer or the insulating layer on the PCB which may affect a usability of the LED.

For example, in a metal-based PCB, the insulating layer and the metallic substrate usually are connected by a press-fit manner, and an airtight performance between the metallic substrate and the insulating layer is affected by the way forming the insulating layer; usually, a certain gap exists between the insulating layer and the metallic substrate, and moisture is likely to enter the sealed space between the lens component and the PCB through the gap between the metallic layer and the insulating layer. Furthermore, the insulating layer is prone to be gradually ageing during usage and be gradually separated from the metallic substrate due to ageing, which makes it easier for the moisture to enter the sealed space between the lens component and the PCB through the gap between the metallic substrate and the insulating layer and hence to affect the usability of the LED element. Moreover, PCBs having a substrate of other materials also involve the problem that the bonding between the substrate and the printed circuit layer or other layer(s) on the substrate is not closely tight enough. Therefore, in the LED module in the embodiment of the present invention, the above-mentioned problem caused by un-tight connection between the substrate and the layer(s) thereon can be solved by directly connecting (or bonding) the sealing part to the substrate.

The metallic substrate in the embodiment of the present invention can be a relatively thicker metallic layer, and the LED element and the metallic substrate are spaced only by the insulating layer and the printed circuit layer, so that an amount of medium layer required for heat conduction is smaller and a performance of heat dispersion is improved. For example, a thickness of the metallic substrate is sufficient to support the LED element and the insulating layer and the printed circuit layer thereon. For example, the thickness of the metallic substrate according to the embodiment of the present invention is 1 mm to 4 mm. For other substrate such as ceramic substrate or plastic substrate, the thickness can also be 1 mm to 4 mm. For the LED module in the embodiment of the present invention, the lens component thereof is directly sealed with the substrate of the PCB. Heat generated during an operation of the LED module can be dissipated to the outside through the substrate of the PCB, without the need of a cooling fin.

For example, the LED module in the embodiment of the present invention further includes a conducting wire 310 for electrically connecting the printed circuit layer to an external power supply. As illustrated in FIG. 1, FIG. 2 or FIG. 4, an end of the conducting wire 310 protrudes into the central region 121 of the substrate 120 so as to be electrically connected to the printed circuit layer, and passes through the periphery region 122 of the substrate 120 (passing through the sealing part 300 in the periphery region 122). The other end of the conducting wire 310 is extending to the outside of the sealed space, so as to be electrically connected to the external power supply. In the embodiment of the present disclosure, the conducting wire passes through the sealing part (gel gasket or adhesion agent) between the lens component and the base plate and is electrically connected to the external power supply. By means of the direct and closely tight connection between the sealing part and the conducting wire, the sealing of the conducting wire and the sealing part is achieved.

Figure 6:
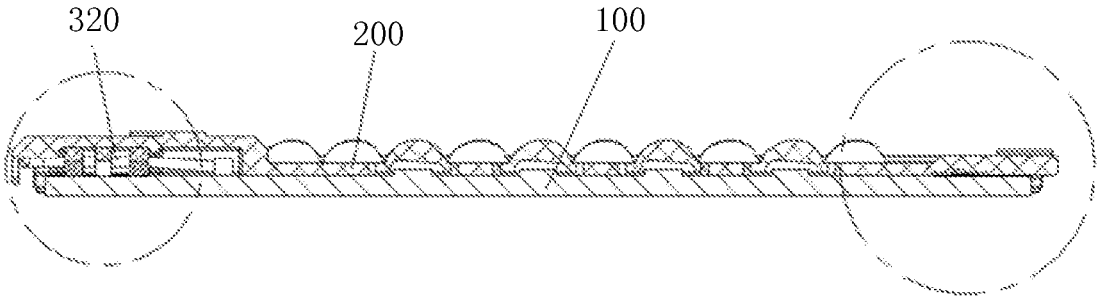
FIG. 6 is a sectional view illustrating a LED module according to an embodiment of the present invention.
Figure 7:
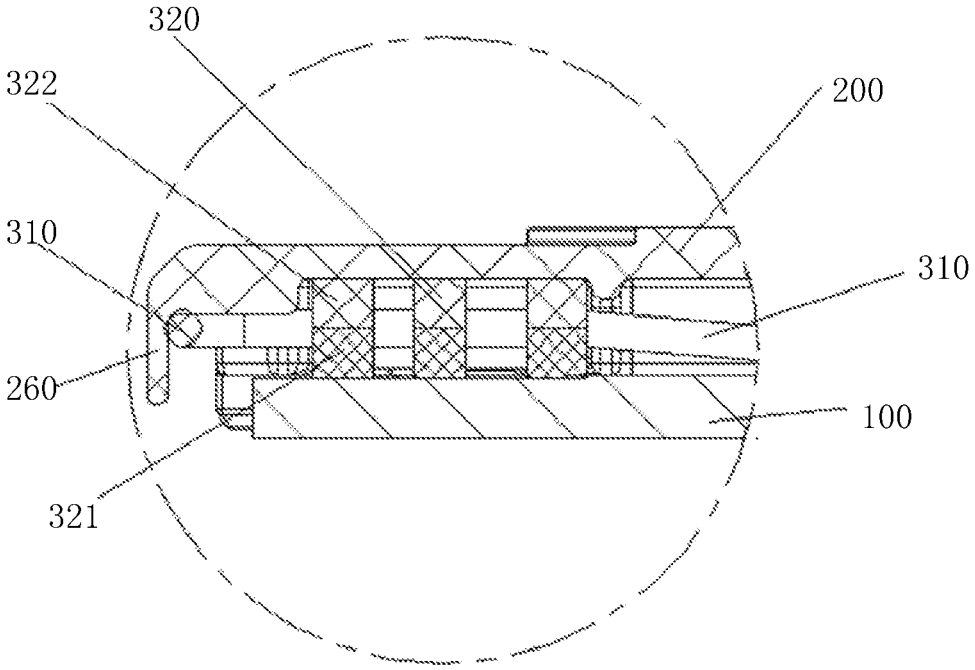
FIG. 7 is a partially sectional view illustrating a LED module according to an embodiment of the present invention.
Figure 9:
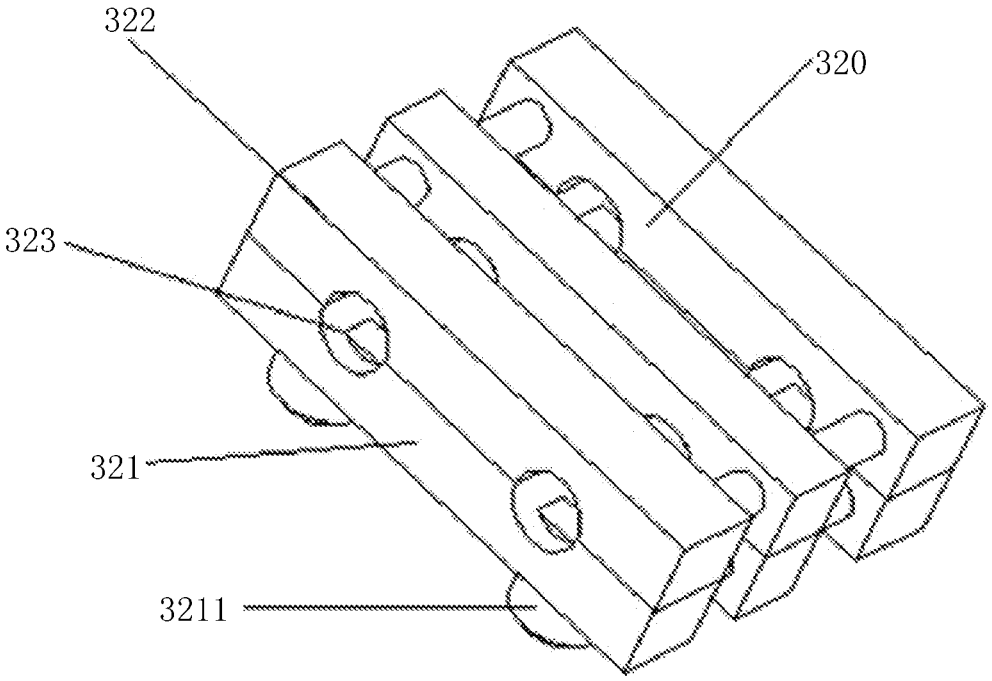
FIG. 9 is a structural view illustrating a wire collector of a LED module according to an embodiment of the present invention.

FIG. 6 is a sectional view illustrating a LED module according to an embodiment of the present invention; FIG. 7 is a partially enlarged view illustrating a portion indicated by a circle at left side of FIG. 6; FIG. 8 is a partially enlarged view illustrating a portion indicated by a circle at right side of FIG. 6; and FIG. 9 is a structural view illustrating a wire collector of a LED module according to an embodiment of the present invention.

Referring to FIG. 1, FIG. 3 and FIG. 8, a side of the lens component 200 facing the base plate 100 is provided with an annular recess 210 for accommodating at least a part of the annular sealing part 300. For example, in the case where the annular sealing part 300 is formed by glue, the glue can be added into the annular recess 210 during the manufacturing process. Moreover, in some examples, as illustrated in FIG. 8, two sides of the annular recess 210 are further provided with a plurality of glue overflow tanks 220, which is convenient for coating the glue and prevents the glue from overflowing. For example, the annular recess 210 and the glue overflow tank 220 are corresponding to the exposed, periphery region of the substrate of the PCB 100. However, the embodiment according to the present invention is not limited thereto, and the glue overflow tank 220 can be provided only on one side of the annular recess 220 or the annular recess 220 is provided with no glue overflow tank. For example, as illustrated in FIG. 3, a portion of the annular recess 220 can have greater width and greater depth, and such portion can be referred to as a glue pool portion 211. That is to say, the glue pool 211 can be regarded as a portion of the recess 210 which is coated with the glue. The depth of the recess refers to a dimension in a direction perpendicular to the lens component, and the width of the recess refers to a dimension in a plane parallel to the lens component, perpendicular to an extending direction of the recess.

The glue pool 211 can be provided with a wire collector 320 for fixing the conducting wire (referring to FIG. 2, FIG. 4, FIG. 6 or FIG. 7). The wire collector 320 is fixed in the glue pool 211. Inside the glue pool 211, a large number of glue (adhesion agent) is coated, so that the wire collector 320 and the conducting wire 310 both are submerged in the glue of the glue pool 211, to achieve a good contact between the conducting wire 310 and the glue, allowing for a better sealing performance at the glue and the conducting wire 321. The glue pool 211 plays the role of accommodating a large number of glue so that the glue can be coated onto a periphery region of the conducting wire 310 upon placing the conducting wire 310 and/or the wire collector 320 in the glue pool, which leads to a tight contact between the conducting wire 310 and the glue, and prevents from any influence to the sealing performance due to a displacement of the conducting wire 310.

In some embodiments, it's also possible that the lens component is not provided with any annular recess for accommodating the glue but is provided with only a glue pool (a recess for accommodating adhesion agent). For example, at least one of the lens component 200 and the base plate 100 is provided with a recess for accommodating adhesion agent at a periphery portion thereof.

For example, the annular recess for accommodating glue (or adhesion agent) can also be disposed on the base plate, or on both of the base plate and the lens component (on surfaces thereof opposite to each other).

Additionally, referring to FIG. 1, FIG. 2 and FIG. 3, the lens component 200 can further be provided with a positioning pin 230 for positioning. The positioning pin 230 is corresponding to a positioning hole in the PCB. For example, the positioning pin 230 can be inserted in the positioning hole 140 in the base plate. In the embodiment according to the present invention, the positioning pin 230 can be provided with a through hole 260. The LED module can be mounted on a lamp housing through the through hole 260.

For example, the lens component and/or the base plate (PCB) can further include a through hole, through which a fixing part for connecting the base plate to an external part (e.g., lamp housing) can pass.

A side of the lens component facing the base plate is further provided with a recess 250 for wiring, so that the conducting wire 310 extending from the PCB of the LED module can be disposed in the recess 250 for better aesthetics of the LED module.

In some embodiments, as illustrated in FIG. 3, the lens component 200 can further include a conducting wire welding recess 270. For example, a position where the conducting wire 310 is welded with the printed circuit layer 120 can be corresponding to the conducting wire welding recess 270.

For example, the lens component 200 also includes a central region and a periphery region surrounding the central region. The lens part 240 is located in the central region of the lens component 200, while the positioning pin 230, the recess 210 on which the glue is to be coated, the glue overflow tank 220, the wiring recess 250, the glue pool 211 and the like are located in the periphery region. When assembling the lens component 200 with the base plate 100 to form an airtight accommodation space, the central region of the lens component 200 is opposite to the central region 111 of the substrate 110 of the base plate, the lens parts 240 on the lens component 200 is corresponding to (e.g., in one-to-one correspondence with) the LED elements 400 on the base plate 100, and the periphery region of the lens component 200 is opposite to the periphery region 112 of the substrate 110 of the base plate. Therefore, the glue (adhesion agent) as coated can directly bond the exposed surface of the substrate 110 with the lens component, so as to prevent from any influence to the sealing performance caused by an interface between the substrate and the insulating layer or other layer(s), or caused by the insulating layer (or other layers) per se.

Referring to FIG. 2, FIG. 3, FIG. 4, FIG. 6, FIG. 7 and FIG. 9, in some embodiments of the present invention, the wire collector 320 includes a first wire collecting part 321 and a second wire collecting part 322; the first wire collecting part 321 is fixedly connected with the substrate 110 of the base plate 100; the first wire collecting part 321 is provided with a first recess which has a semicircle-shaped cross section (the cross section can also be any un-closed graph); the second wire collecting part 322 is also provided with a second recess which has a semicircle-shaped cross section (the cross section can also be any un-closed graph) and which is matched with the first recess. The first wire collecting part 321 and the second wire collecting part 322 are fixedly connected; the conducting wire 310 passes through the first recess and the second recess, and is fitted between the first wire collecting part 321 and the second wire collecting part 322. As illustrated in FIG. 9, the first recess of the first wire collecting part and the second recess of the second wire collecting part form a conducting wire through hole 323 upon mounting the first wire collecting part and the second wire collecting part together, and the conducting wire 310 can pass through the conducting wire through hole 323. The wire collector 320 not only can fix the conducting wire 310 but also prevents the conducting wire 310 from contacting the lens component 200 or the base plate 100 which may cause the problem of poor contact between the conducting wire 310 and the glue, thereby improving the sealing performance.

For example, the first wire collecting part 321 is provided with a first positioning column 3211 so as to be connected with the substrate 110 of the base plate 100 through the positioning column 3211. In the embodiment of the present invention, by means of an interference fit between the first positioning column 3211 and a first positioning hole 150 in the substrate 110, the first wire collecting part 321 is fixed on the substrate 110. By means of an interference fit between a second positioning column (not illustrated) on the second wire collecting part 322 and a second positioning hole (not illustrated) in the first wire collecting part 321, the first wire collecting part 321 is fixedly connected with the second wire collecting part 322. In this way, it achieves fixing the conducting wire 310 on the base plate 100.

In the example above, the way of connecting the first wire collecting part 321 to the substrate 110, and the way of connecting the second wire collecting part 322 to the first wire collecting part 321 are merely illustrative, without limiting the embodiment of the present invention thereto.

The wire collector 320 can be fixed on the periphery region of the base plate 100 (i.e., the periphery region of the substrate 110), for example, the periphery region of the substrate 110 which is not covered by the insulating layer or the printed circuit layer.

Referring to FIG. 9, a plurality of wire collectors 320 can be provided and connected at intervals. For example, the plurality of wire collectors 320 can be arranged along an extending direction of the conducting wire, and are disposed at intervals. In this way, the conducting line can be sufficiently fixed by the wire collector 320 as far as possible and can also be in sufficient contact with the glue at the same time, so as to ensure a good sealing performance.

As illustrated in FIG. 7, the conducting wire 310 passes through the wire collector 320 between the lens component 200 and the base plate 100, so as to extend from inside to outside of the sealed space. Moreover, in an example, as illustrated in FIG. 7, the lens component 200 can further include a wire blocking part 260 for blocking the conductive wire 310 which is extending to the outside.

The conducting wire is extending from the glue pool 211, and then is directly sealed by using a sealing part (or an adhesion agent), so as to avoid a secondary sealing which is required when the conducting wire 310 passes through the lens component 200 or base plate 100. Furthermore, as compared with the technical solution in which the conducting wire passes through the PCB, it has no need of forming a hole in a portion of the PCB arranged with the insulating layer and a print circuit to allow the conducting wire to extend to the outside, which reduces the difficulty in manufacturing the PCB and saves the manufacturing cost.

The above is described with reference to the case where the conducting wire extends from inside to outside of the sealed space, between the lens component and the base plate of the LED element, by way of example. However, the embodiment according to the present invention is not limited thereto. For example, the conducting line can extend from inside to outside of the sealed space through a through hole in the lens component.

Moreover, according to the embodiment of the present invention, an electric connection of the LED element to the outside is achieved by a conducting line passing through the sealing part (adhesion agent), and the conducting wire extends from a space between the lens component and the base plate, which eliminates the need of providing a through hole in the base plate or in the lens component to allow the conducting wire to pass there-through. Additionally, the conducting wire can be in close contact with the glue so as to ensure the sealing performance.

In some embodiments according to the present invention, a transparent gel can be filled between each lens part of the lens component and the LED element. Light emitted from the LED element passes through the light emergent side of the LED element, then passes through the space between the lens part and the LED element, and then exits upon transmitting through the lens part. A refractivity of the transparent gel is greater than that of the air and the lens part, and the refractivity of the lens part is greater than that of the air. When no gel is filled between the lens part and the LED element, the light emitted from the LED element passes through the space between the lens part and the LED element, that is, air dielectric, and then exits upon transmitting through the lens part; in this way, the light emitted from the LED element passes through the air having a relatively lower refractivity and then exits upon transmitting through the lens part having a refractivity greater than that of the air. When the transparent gel is filled between the lens part and the LED element, the light emitted from the LED element passes through the transparent gel between the lens part and the LED element, and then exits upon transmitting through the lens part; in this way, the light emitted from the LED element passes through the transparent gel having a relatively greater refractivity and then exits upon transmitting through the lens part having a relatively lower refractivity. When the light is propagating from a side having a greater refractivity to a medium having a smaller refractivity, a loss of lighting effect is smaller than that of the case where the light is propagating from a side having a smaller refractivity to a medium having a greater refractivity. Therefore, the luminous efficiency is higher in the case of filling a transparent gel, as compared to the case of filling no transparent gel.

A concave portion of the lens part may not be provided with the transparent gel. The gel can be filled in such a manner that a space between the entire lens and the base plate is filled with the gel or only the concave portion of the lens part is filled with the gel.

Moreover, as illustrated in FIG. 6, a part of the lens component 200 can be in contact with the base plate 100, so that a space for accommodating the LED element is only reserved at the concave portion of the lens part 240. However, the LED module according to the embodiment of the present invention is not limited thereto, and the lens component 200 may not be in direct contact with the base plate 100.

As compared to the structure in which the PCB is disposed among the lens component, the base plate and the sealing gel, the embodiment of the present invention extends the substrate of the PCB to an outer side of the sealing part, so as to increase an area of the substrate (e.g., metallic substrate) of the PCB, that is, increasing a cooling area, which facilitates heat dissipation.

In the LED module of the embodiment of the present invention, the lens component is fixedly connected with the PCB. When mounting the LED module on the lamp housing, a back surface of the substrate (e.g., metallic substrate) of the PCB of the LED module is bonded with the lamp housing. Heat generated by the LED element is conveyed to the lamp housing through the substrate of the PCB. Because the lamp housing of the LED lamp is usually made of a metallic material, the heat of the substrate conveyed onto the lamp housing is dissipated to the air through the lamp housing; that is, cooling by utilizing the lamp housing of the LED lamp. As compared to the exiting LED module, a contact area of the LED lamp housing with the air is relatively larger, which results in a heat conduction condition of the LED module better than that of the exiting lamp housing provided with a LED module. Additionally, it has no need of providing a separate, heat sink on the LED module, and the LED module will have a simpler structure, which eliminates the need of manufacturing a heat sink with complicated shape and structure, saves the material, decreases a weight of the module and reduces the cost.

Additionally, in the embodiment of the present invention, the LED module is bonded with (e.g., in surface bonding with, or in surface contact with) the lamp housing. As compared with the exiting lamp provided with a LED module, a dimension of an inner chamber of the lamp housing is smaller, a structure of the lamp is more compact, a weight and a material of the lamp housing is reduced, and the cost is saved.

The embodiment of the present invention further provides a manufacturing method (an assembling method) of a LED module.

In an example, an assembling sequence is as follows: electrically connecting a LED element with a base plate; fixing a conducting wire by using a wire collector; welding the conducting wire onto the base plate; fixing the wire collector on the base plate; placing a lens component with a concave surface thereof (a side opposite to the base plate) facing up, and coating a glue onto a recess for accommodating glue on the lens component; passing a positioning pin of the lens component through a positioning hole in the PCB to assemble the lens component with the PCB; placing the LED module onto a clamp provided with a heat sink, attaching a metallic layer of the PCB with the heat sink on the clamp, and tightly clamping the LED module by the clamp for aging.

In another example, an assembling sequence is as follows: electrically connecting a LED element with a PCB; fixing a first wire collecting part of a wire collector on a base plate; welding a conducting wire onto the base plate; fixing the conducting wire on the first wire collecting part; assembling a second wire collecting part with the first wire collecting part to fix the conducting wire in the wire collector; placing a lens component with a concave surface thereof (a side opposite to the base plate) facing up, and coating a glue onto a recess for accommodating glue on the lens component; passing a positioning pin of the lens component through a positioning hole in the PCB to assemble the lens component with the base plate; placing the LED module onto a clamp provided with a heat sink, attaching a metallic layer of the base plate with the heat sink on the clamp, and tightly clamping the LED module by the clamp for aging.

The manufacturing steps above merely are some example steps according to the embodiment of the present invention. In general, the manufacturing method of the LED module according to the embodiment of the present invention can include steps as below: a step of connecting a LED element to a base plate; a step of electrically connecting a conducting wire to the base plate (e.g., to a printed circuit layer on a PCB); and a step of disposing a lens component to be opposite to the PCB and disposing an annular sealing part between the lens component and the PCB. A sequence of these steps is not particularly limited, except the last one. Additionally, the manufacturing method according to the embodiment of the present invention can further include some other steps illustrated in the examples above.

The steps above are merely illustrative. For example, the step of disposing a lens component to be opposite to the PCB and disposing an annular sealing part between the lens component and the PCB can be: firstly disposing the sealing part on at least one of the lens component and the PCB, and then assembling the lens component with the PCB.

The embodiment of the present invention further provides a lamp, including a lamp housing and a LED module, the lamp housing includes a chamber in which the LED module is fixed therein.

In some embodiments, the lamp further includes a power supply component, and the power supply component is electrically connected to the LED module through a conducting wire and is used for supplying the LED module with electric power. For example, the power supply component is disposed inside the lamp housing.

For example, the chamber above can be a sealed chamber.

For example, the LED module included in the lamp can be any one according to the embodiments of the present invention.

For example, the lamp housing includes a lower cover and an upper cover, the lower cover includes a transparent region to allow light emitted from the LED module to pass therethrough, and the LED module is fixed on the upper cover.

For example, the base plate of the LED module is in surface contact with the upper cover. The substrate of the base plate of the LED can be in surface contact with the upper cover of the lamp, which facilitates dissipating the heat generated in the LED element during operation to the outside through the upper cover of the lamp. Furthermore, in the case where the base plate is a metal-based PCB, a contact of a metallic substrate used as a substrate of the base plate with the upper cover will be more beneficial for the heat generated in the LED module during operation to be dissipated to the outside through the metallic substrate and the upper cover.

For example, the lamp housing further includes a pivot component, and the upper cover and the lower cover are rotatable about the pivot component.

For example, the upper cover of the lamp housing can be a detachable structure.

Figure 10:
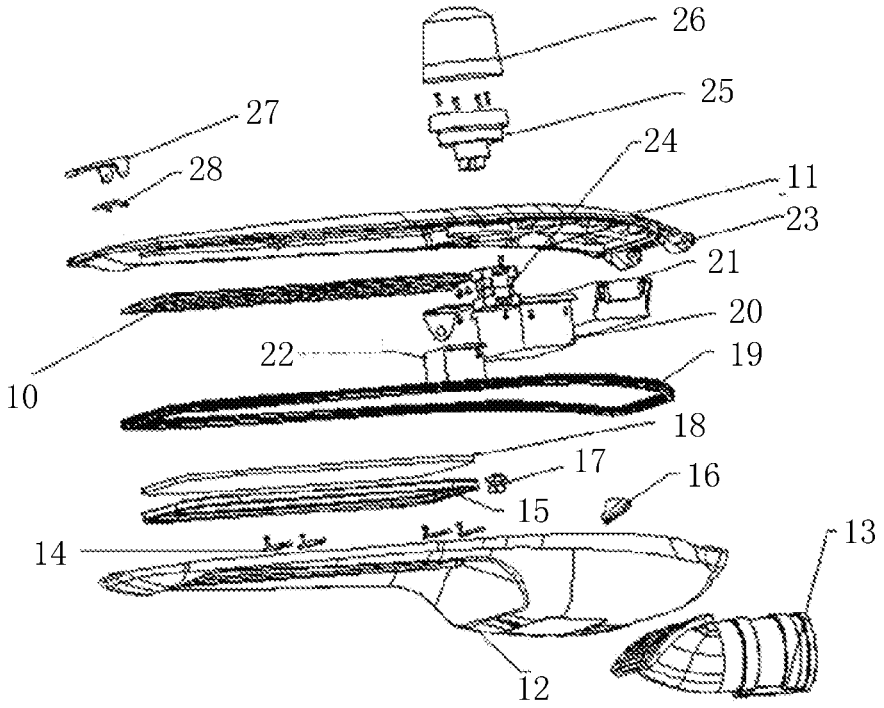
FIG. 10 is an exploded view illustrating a LED module according to an embodiment of the present invention.

FIG. 10 illustrates an example structure. The LED lamp according to the embodiment of the present invention includes a lamp housing, a LED module 10 and a power supply component 21. The lamp housing is a hollow, sealed chamber in which the LED module 10 and the power supply component 21 are fixed. The power supply component 21 is electrically connected to the LED module 10 through a conducting wire, and is used for supplying the LED module with electric power.

The LED module 10 is a LED module in any of the embodiments above.

For example, the lamp housing includes a lower cover 12, an upper cover 11 and a pivot component 23. The upper cover 11 and the lower cover 12 are rotatably connected through the pivot component 23, so that the upper cover 11 and the lower cover 12 are relatively rotatable about the pivot component 23. The upper cover 11 and the lower cover 12, upon assembling, form a sealed chamber therebetween, and are further provided with a circle of sealing ring 19 where the upper cover 11 is assembled with the lower cover 12, so as to ensure a sealing performance between the upper cover 11 and the lower cover 12.

For example, the LED module 10 and the power supply component 21 are fixed on the upper cover 11 through a fixing member.

The lower cover 12 is provided with an opening at a location opposite to the LED module 10, and the opening is corresponding to the light emergent side of the LED module 10. The opening is further provided with a light-transmitting plate 18, and a sealing ring 15 is further disposed between the opening of the lower cover and the light-transmitting plate 18, the lower cover 12 is further provided with a plurality of pressers 14 each for fixing the light-transmitting plate 18 onto the lower cover 12 so that the sealing ring 15 is elastically deformed between the light-transmitting plate 18 and the lower cover 12 to seal the opening of the lower cover 12. The light-transmitting plate 18 can be a tempered glass, and the light emitted from the LED module exits the lamp housing upon transmitting through the light-transmitting plate 18.

The LED module in the embodiment of the present invention is disposed inside the lamp housing which is entirely formed into a sealed chamber. As compared with the existing lamp with a module in which the lamp housing is provided with a plurality of air holes or other ventilation structure(s), it's not easy for dusts to be accumulated in or for moisture to enter the airtight lamp housing. This provides better protection for elements and components disposed in the lamp housing such as the power supply component and the LED module.

In the embodiment of the present invention, the power supply component and the LED module both are fixed on the upper cover, and the upper cover is fixedly connected with the lower cover through a hinge. The upper cover and the lower cover can be detached from each other by manually rotating the hinge, and then the upper cover can be rotated about the lower cover through the pivot component. When the upper cover is rotated to a certain angle with respect to the lower cover, the upper cover and the lower cover are separated from each other. The power supply component and the LED module both are mounted on the upper cover. When assembling the lamp, firstly, the power supply component and the LED module can be mounted on the upper cover, and then the upper cover, the LED module, the power supply component and the like can be mounted, as a whole, onto the lower cover, which is convenient for mounting. When maintaining the lamp, the upper cover, the LED module and the power supply component can be detached, as a whole, from the lamp without the need of detaching the entire lamp from a lamp post, which is convenient for maintenance of the lamp.

The lower cover is further provided with a lamp post mounting part and a lamp post connecting part 13 corresponding to the lamp post mounting part. Particularly, the lamp post mounting part is provided with a plurality of first dentate protrusions, the lamp post connecting part 13 is provided with a plurality of second dentate protrusions corresponding to the first dentate protrusions, respectively, and the first dentate protrusions are engaged with the second dentate protrusions, respectively. By changing a position where the first dentate protrusion is engaged with the second dentate protrusion, a mounting angle between the lamp post connecting part and the lamp post mounting part can be adjusted, so as to adjust an angle of the lamp upon mounting the lamp on the lamp post.

For example, in the present application, the LED module is disposed inside a sealed lamp housing, and a base plate of the LED module can be directly attached with the lamp housing. The heat generated by the LED module can be conveyed to the lamp housing through the base plate and then be dissipated to the outside, so that the lamp housing has no need of a cooling fin for heat dissipation. However, the embodiment of the present invention is not limited thereto, and the LED module in the present application can also be directly disposed on a non-sealed lamp housing.

In the lamp according to the embodiment of the present invention, the base plate of the LED module can be in surface contact with the upper cover of the lamp housing. Because the base plate of the LED module can be a metal-based PCB, the heat generated during the operation of the LED module can be conveyed to the upper cover of the lamp housing through the metallic substrate of the metal-based PCB and then be dissipated to the outside. For example, the upper cover can be made from a material (e.g., metal) with good thermal conductivity.

In the embodiment according to the present invention, when mounting the LED module in the lamp housing, the side of the base plate faces the upper cover while the side of the lens component faces the lower cover, so that the light emitted from the LED module can exit through the transparent region of the lower cover.

Additionally, in an example illustrated in FIG. 10, some other components are illustrate, for example, a light-dependent controller 26, a light-dependent controller base 25, a hook 27, a hook spring 28, a thunder preventer 22, a respirator 17, an overcurrent coil 16, a controller 20, a cover-open power-off switch 24 and the like. Some of components illustrated in FIG. 10 can be replaced or omitted according to actual demands, and other component(s) can also be added as required.

Some embodiments according to the present invention provide a light-emitting diode (LED) module, including: at least one LED element; a base plate of the LED element for supporting the LED element; a lens component disposed above a light emergent side of the LED element, the lens component is provided with at least one lens part; and a gel gasket disposed between the lens component and the base plate of the LED element. The LED element is located within a sealed space formed by the lens component, the base plate of the LED element and the gel gasket.

In some examples, each lens part corresponds to one LED element, and is used for performing a light distribution to the corresponding LED element.

In some examples, the base plate of the LED element is a metal-based print circuit board (PCB).

In some examples, the metal-based PCB includes: a metallic plate; and an insulating layer and a printed circuit layer formed on the metallic plate.

In some examples, the printed circuit layer is formed on the insulating layer so as to be electrically isolated from the metallic plate.

In some examples, a surface of the metallic plate includes a central region and a periphery region surrounding the central region; the insulating layer and the printed circuit layer are only formed in the central region of the surface of the metallic plate; and the periphery region of the surface of the metallic plate is not covered by the insulating layer.

In some examples, a thickness of the metallic plate is sufficient to support the LED element as well as the insulating layer and the printed circuit layer on the LED element.

In some examples, the LED element is disposed on the metal-based PCB and is electrically connected to the printed circuit layer.

In some examples, the metal plate is a plate-shaped component, for example, a flat plate-shaped component.

In some examples, the gel gasket is in direct contact with the lens component and the surface of the metallic plate which is not covered by the insulating layer.

In some examples, the gel gasket is disposed at an outer side of the insulating layer.

In some examples, the gel gasket is formed by a liquid adhesion agent after being solidified, and the gel gasket bonds the base plate with the lens component so as to form the sealed space.

In some examples, the lens component and the base plate have a hole or a notch which allows a positioning part or a fixing part to pass therethrough.

In some examples, a side of the lens component facing the base plate is provided with an annular recess, and the gel gasket is disposed in the annular recess.

In some examples, the gel gasket is disposed in the annular recess.

In some examples, one side or two sides of the annular recess is/are provided with at least one glue overflow tank.

In some examples, the annular recess includes a glue pool, and a depth and a width of the glue pool both are greater than those of the remaining portion of the annular recess.

In some examples, the LED module further includes a conducting wire, which extends from inside to outside of the sealed space by passing through the gel gasket.

In some examples, the LED module further includes a wire collector, the wire collector is disposed between the lens component and the base plate and is located in the gel gasket, and the conducting wire passes through the wire collector.

In some examples, the wire collector is disposed at a position of the glue pool.

In some examples, the wire collector includes a first wire collecting part and a second wire collecting part, sides of the first wire collecting part and the second wire collecting part facing to each other are provided with recesses corresponding to each other, so as to form a hole through which the conducting wire passes, upon overlapping the first wire collecting part with the second wire collecting part.

In some examples, the first wire collecting part is fixed on the periphery region of the surface of the metallic plate of the base plate which is not covered by the insulating layer.

In some examples, the first wire collecting part includes a first positioning column, and is connected to the metallic plate of the base plate through the first positioning column.

In some examples, the LED module further includes a positioning pin disposed on the lens component, and the poisoning pin is used for inserting into a positioning hole in the base plate.

In some examples, a transparent gel is filled between each lens part of the lens component and the corresponding LED element.

In some examples, a refractivity of the transparent gel is greater than a refractivity of the air and a refractivity of the lens part.

Some other embodiments according to the present invention provide a manufacturing method of a LED module, including: connecting a LED element to a PCB; electrically connecting a conducting wire to the PCB; coating an adhesion agent onto a lens component and bonding the lens component with the PCB.

In some examples, a base plate of the LED element is a metal-based PCB which includes a metallic plate as well as an insulating layer and a printed circuit layer formed on the metallic plate.

In some examples, a surface of the metallic plate includes a central region and a periphery region surrounding the central region; the insulating layer and the printed circuit layer are only formed in the central region of the surface of the metallic plate; and the periphery region of the surface of the metallic plate is not covered by the insulating layer.

In some examples, upon bonding the lens component with the base plate, the adhesion agent coated on the lens component corresponds to the periphery region of the metallic plate which is not covered by the insulating layer.

Some other embodiments according to the present invention provide a lamp, including a lamp housing and a LED module. The lamp housing includes a chamber in which the LED module is fixed; and the LED module is a LED module described in any of the foregoing embodiments.

In some examples, the lamp further includes a power supply component. The power supply component is electrically connected to the LED module through a conducting wire, and is used for supplying the LED module with electric power.

In some examples, the chamber is a sealed chamber.

In some examples, the base plate of the LED module is in surface contact with at least a part of the lamp housing.

In some examples, the lamp housing includes a lower cover and an upper cover, the lower cover includes a transparent which allows light emitted from the LED module to pass therethrough, and the LED module is fixed on the upper cover.

In some examples, the base plate of the LED module is in surface contact with the upper cover.

In some examples, the lamp housing further includes a pivot component, and the upper cover and the lower cover are rotatable about the pivot component.

In some examples, the upper cover of the lamp housing is a detachable structure.

The above are merely exemplary implementations of the present invention without limiting the protection scope of the present invention thereto. The protection scope of the present invention is defined by the appended claims.

The present application claims the priority of the Chinese patent application No. 201610140714.1 filed on Mar. 11, 2016, the entirety of the above-mentioned Chinese patent application is incorporated herein by reference as a part of the present application.

We claim:

1. A light-emitting diode (LED) module, comprising:

at least one LED element;

a base plate for supporting the LED element;

a lens component disposed at a light emergent side of the LED element; and an annular sealing part disposed between the lens component and the base plate, wherein the LED element is located within a sealed space formed by the lens component, the base plate and the annular sealing part, wherein the base plate is a print circuit board (PCB), wherein the PCB comprises a substrate and a printed circuit layer formed at a side of the substrate facing the lens component, wherein the substrate comprises a central region and a periphery region surrounding the central region, the printed circuit layer is only formed in the central region of the substrate, and wherein the annular sealing part is located in the periphery region of the substrate so as to be in direct contact with the substrate.

2. The LED module according to claim 1, wherein the annular sealing part is in direct contact with the lens component and the base plate, respectively, so as to form the sealed space between the lens component and t base plate.

3. The LED module according to claim 1, wherein the substrate is at least one of a metallic substrate, a ceramic substrate and a plastic substrate.

4. The LED module according to claim 3, wherein the substrate is a metallic substrate, and an insulating layer is further provided between the printed circuit layer and the substrate.

5. The LED module according to claim 4, wherein the insulating layer is only located in the central region of the substrate, the insulating layer comprises a central region and a periphery region surrounding the central region, and the printed circuit layer is formed in the central region of the insulating layer.

6. The LED module according to claim 1, wherein the LED element is electrically connected to the printed circuit layer.

7. The LED module according to claim 1, wherein a side of the lens component facing the base plate is provided with an annular recess, and at least a part of the annular sealing part is disposed in the annular recess.

8. The LED module according to claim 1, further comprising a conducting wire, wherein the conducting wire extends from inside to outside of the sealed space by passing through the annular sealing part.

9. The LED module according to claim 8, further comprising a wire collector, wherein the wire collector is disposed between the lens component and the base plate, and is located in the annular sealing part, and the conducting wire passes through the wire collector.

10. The LED module according to claim 9, wherein the annular recess comprises a glue pool, and a depth and a width of the glue pool are both greater than those of the remaining portion of the annular recess, and the wire collector is disposed at a position of the glue pool.

11. The LED module according to claim 1, wherein a thickness of the substrate of the PCB is in the range of 1 mm to 4 mm.

12. A lamp, comprising a lamp housing and a light-emitting diode (LED) module according to claim 1, wherein the lamp housing comprises a chamber in which the LED module is fixed.

13. The lamp according to claim 12, wherein the chamber is a sealed chamber.

14. The lamp according to claim 12, wherein a base plate of the LED module is in surface contact with at least a part of the lamp housing.

15. A manufacturing method of a light-emitting diode (LED) module, comprising:

connecting a LED element to a print circuit board (PCB);

electrically connecting a conducting wire to the PCB;

disposing a lens component to be opposite to the PCB, and disposing an annular sealing part between the lens component and the PCB, so as to form an sealed space enclosed by the annular sealing part and between the lens component and a base plate, wherein the LED element is located within the sealed space, wherein the PCB comprises a substrate and a printed circuit layer formed on the substrate, the substrate comprises a central region and a periphery region surrounding the central region, and the printed circuit layer is only located in the central region of the substrate, wherein upon bonding the lens component with the PCB, the annular sealing part corresponds to the periphery region of the substrate and is in direct contact with the substrate.

* * * * *